US009844948B2

(12) United States Patent
Ando

(10) Patent No.: US 9,844,948 B2
(45) Date of Patent: Dec. 19, 2017

(54) PRINTING APPARATUS WITH INK CIRCULATION FLOW PATH

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/046,951

(22) Filed: Feb. 18, 2016

(65) Prior Publication Data

US 2016/0271966 A1 Sep. 22, 2016

(30) Foreign Application Priority Data

Mar. 19, 2015 (JP) ..... 2015-055790

(51) Int. Cl.
*B41J 2/175* (2006.01)
*B41J 2/18* (2006.01)

(52) U.S. Cl.
CPC *B41J 2/18* (2013.01); *B41J 2/175* (2013.01)

(58) Field of Classification Search
None
See application file for complete search history.

(56) References Cited

U.S. PATENT DOCUMENTS 4,737,801 A * 4/1988 Ichihashi ..... B41J 2/16523 137/392
2009/0109267 A1* 4/2009 Lee ..... B41J 2/175 347/89
2011/0211029 A1* 9/2011 Enomoto ..... B41J 2/175 347/93
2011/0242156 A1* 10/2011 Shimoda ..... B41J 2/175 347/6
2013/0169710 A1* 7/2013 Keefe ..... B41J 2/175 347/17
2013/0286120 A1* 10/2013 Kobayashi ..... B41J 11/002 347/102

FOREIGN PATENT DOCUMENTS

JP 2013-240980 A 12/2013

* cited by examiner

*Primary Examiner* — Bradley Thies
(74) *Attorney, Agent, or Firm* — Global IP Counselors, LLP

(57) ABSTRACT

A printing apparatus includes an ink ejecting head which ejects a UV ink, a sub-tank which reserves the UV ink, an ink circulation flow path which includes a circulation outgoing path in which the UV ink which is supplied to the ink ejecting head from the sub-tank flows and a circulation return path in which the UV ink which returns to sub-tank from the ink ejecting head flows, and a check valve which is provided in the circulation return path and is capable of opening and closing the circulation return path, in which the circulation return path is opened by the check valve when the UV ink flows in the circulation return path in a forward direction, and the circulation return path is closed by the check valve when the UV ink flows in the circulation return path in a reverse direction.

9 Claims, 3 Drawing Sheets

PRINTING APPARATUS WITH INK CIRCULATION FLOW PATH

BACKGROUND

1. Technical Field

The present invention relates to a printing apparatus which is provided with an ink circulation flow path which is configured to include an ink ejecting head.

2. Related Art

In the related art, a printer is known which is provided with a head unit, a sub-tank, an ink circulation flow path, and a filter. The head unit ejects an ink, the sub-tank reserves the ink, the ink circulation flow path includes a circulation outgoing path in which the ink which is supplied from the sub-tank to the head flows and a circulation return path in which the ink which returns to the sub-tank from the head unit flows, and the filter is provided in the circulation outgoing path. In this printer, foreign matter in the ink is prevented from flowing into each head of the head unit by filtering the ink using the filter (refer to JP-A-2013-240980).

The present inventor discovered the following problems.

In a printing apparatus which is provided with an ink circulation flow path configured to include an ink ejecting head, when a circulation return path is removed from an ink reservoir section in order to exchange the ink ejecting head, during the cleaning of the ink ejecting head, and the like, there is a case in which the ink flows backward to the ink ejecting head in the circulation return path. There is a concern that foreign matter contained in the ink will flow into the ink ejecting head together with the backward flow of the ink to the ink ejecting head in the circulation return path.

SUMMARY

An advantage of some aspects of the invention is to provide a printing apparatus capable of suppressing the flowing of foreign matter into the ink ejecting head together with the backward flow of the ink to the ink ejecting head in the circulation return path.

According to an aspect of the invention, there is provided a printing apparatus which includes an ink ejecting head which ejects an ink, an ink reservoir section which reserves the ink, an ink circulation flow path which includes a circulation outgoing path in which the ink which is supplied to the ink ejecting head from the ink reservoir section flows and a circulation return path in which the ink which returns to the ink reservoir section from the ink ejecting head flows, and an open-close section which is provided in the circulation return path and is capable of opening and closing the circulation return path, in which the circulation return path is opened by the open-close section when the ink flows in the circulation return path in a forward direction, and the circulation return path is closed by the open-close section when the ink flows in the circulation return path in a reverse direction.

In this case, when the ink flows in the circulation return path in the reverse direction, the ink is prevented from flowing into the ink ejecting head. Accordingly, foreign objects contained in the ink which flows backward flowing into the ink ejecting head is suppressed. Therefore, in the printing apparatus, it is possible to suppress the flowing of foreign matter into the ink ejecting heads together with the backward flow of the ink to the ink ejecting head in the circulation return path.

In this case, the open-close section preferably includes a check valve.

In this case, the check valve opens the circulation return path when the ink flows in the circulation return path in the forward direction, and the check valve closes the circulation return path when the ink flows in the circulation return path in the reverse direction. Therefore, it is possible to increase the reliability as an open-close section.

The printing apparatus preferably includes a plurality of the ink ejecting heads, in which the circulation return path preferably contains a plurality of branch paths, one end portion of each being joined to the corresponding ink ejecting head, and a root path at which the plurality of branch paths merge at another end portion side of the branch paths, and in which the open-close section is preferably provided in the root path.

In this case, even if the open-close section is not provided in each of the branch paths, it is possible to suppress the flowing of foreign matter into the plurality of ink ejecting heads together with the backward flow of the ink to the plurality of ink ejecting heads in the circulation return path. Therefore, in this case, it is possible to reduce the number of open-close sections in comparison to a case in which the open-close section is provided in each of the branch paths.

The printing apparatus preferably includes a plurality of the ink ejecting heads, and a plurality of the open-close sections, in which the circulation return path preferably contains a plurality of branch paths, one end portion of each being joined to the corresponding ink ejecting head, and the open-close section is preferably provided in each of the branch paths.

In this case, in comparison to a case in which the open-close section is provided in the root path at which the plurality of branch paths merge, it is possible to more reliably suppress the flowing of foreign matter into the ink ejecting heads together with the backward flow of the ink to the ink ejecting heads in the circulation return path.

The printing apparatus preferably further includes a filter which is provided in the circulation outgoing path and filters the ink.

In this case, foreign matter contained in the ink which flows to the ink ejecting head in the circulation outgoing path is captured in the filter. Therefore, foreign matter contained in the ink which flows to the ink ejecting head in the circulation outgoing path flowing into the ink ejecting head is suppressed.

In the printing apparatus, a back pressure within a predetermined range is preferably applied to the ink inside the ink ejecting head based on a differential head between the ink ejecting head and the ink reservoir section and a pressure loss of the ink in the circulation return path.

In this case, the pressure loss of the ink in the circulation return path is reduced. Therefore, it is not necessary to increase a differential head of the negative pressure on the ink ejecting head in order to retain the head back pressure within a predetermined range. Therefore, even when the circulation of the ink in the ink circulation flow path is stopped, a great reduction in the head back pressure is suppressed. Therefore, in this case, even when the circulation of the ink in the ink circulation flow path is stopped, it is possible to suppress the entry of bubbles from the nozzles of the ink ejecting heads.

The printing apparatus preferably further includes a circulation pump which is provided in the ink circulation flow path and causes the ink to circulate within the ink circulation flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of a printing apparatus 1 according to the embodiment of the invention with reference to the accompanying drawings.

Figure 1:
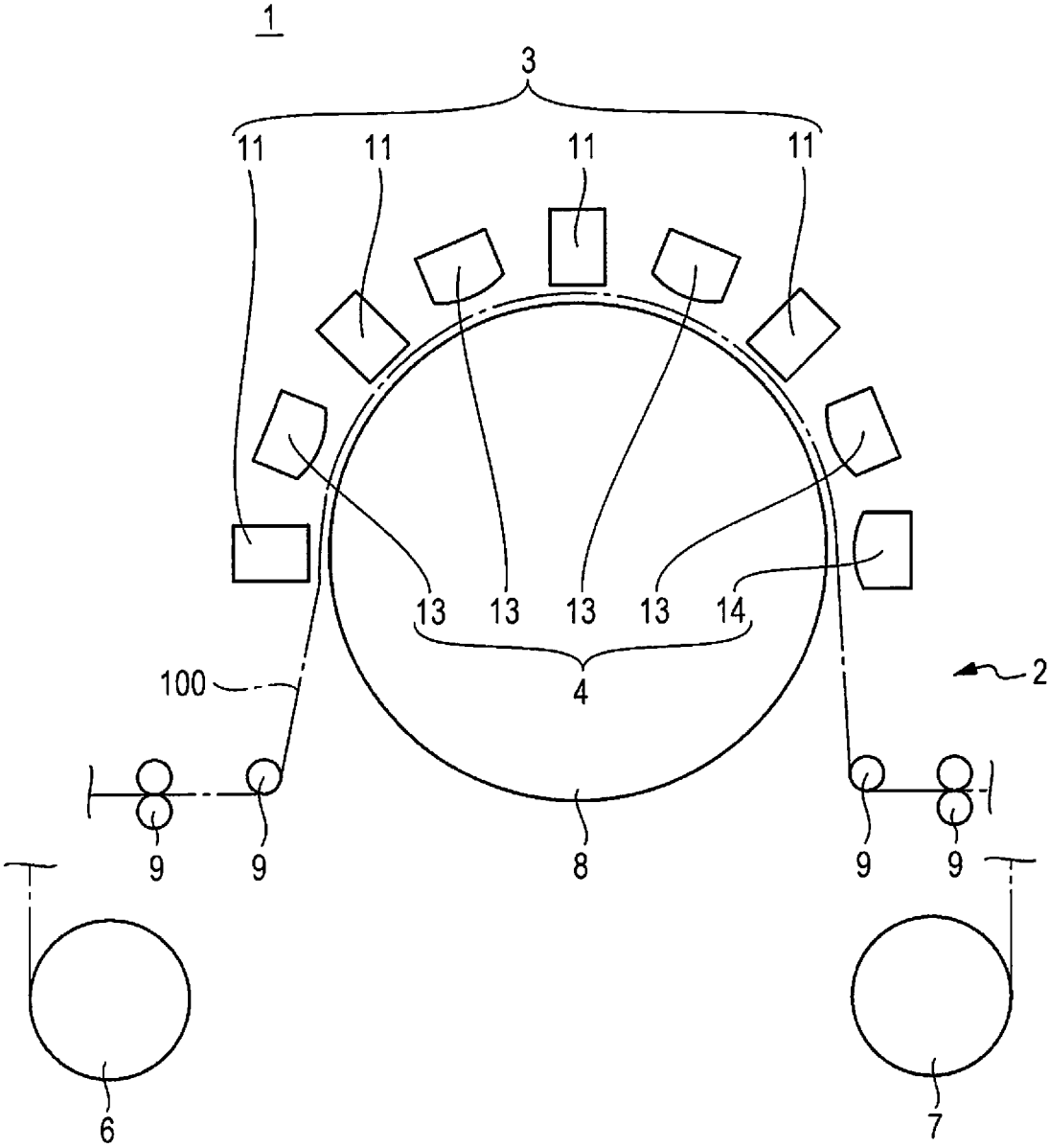
FIG. 1 is a schematic configuration diagram of a printing apparatus according to an embodiment of the invention.

Description will be given of the overall configuration of the printing apparatus 1 with reference to FIG. 1. The printing apparatus 1 performs printing on a printing medium 100 which is set therein by ejecting an ultraviolet curing ink (hereinafter referred to as "a UV ink"). The printing medium 100 is a belt-shaped continuous paper sheet. Note that, the material of the printing medium 100 is not particularly limited, and various materials such as paper-based materials and film-based materials may be used.

The printing apparatus 1 is provided with a feed section 2, an ink ejecting section 3, and an irradiating section 4. Although omitted from the drawing in FIG. 1, the printing apparatus 1 is provided with an ink supply section 5 (refer to FIG. 2) which supplies a UV ink to the ink ejecting section 3.

The feed section 2 is a roll-to-roll system and feeds the printing medium 100. The feed section 2 is provided with a feed-out reel 6, a winding reel 7, a rotating drum 8, and a plurality of rollers 9. The printing medium 100 which is fed out from the feed-out reel 6 passes the rotating drum 8 and the plurality of rollers 9 and is wound onto the winding reel 7. The rotating drum 8 is a cylindrical drum which is supported by a supporting mechanism (not shown) to be capable of rotating. When the printing medium 100 is fed along the circumferential surface of the rotating drum 8, the rotating drum 8 is passively rotated due to the friction force between the circumferential surface and the printing medium 100. The rotating drum 8 functions as a platen in relation to the ink ejecting section 3.

The ink ejecting section 3 is provided with a plurality of head units 11. The plurality of head units 11 is provided to line up along the circumferential surface of the rotating drum 8. The plurality of head units 11 correspond, one-for-one, with a plurality of types of UV ink (for example, the four colors CYMK). Each of the head units 11 is provided with a plurality of ink ejecting heads 12 (refer to FIG. 2) which eject UV ink using an ink jet system. The head units 11 eject the UV inks onto the printing medium 100 which is supported on the circumferential surface of the rotating drum 8. Accordingly, a color image is formed on the printing medium 100.

The irradiating section 4 is provided with a plurality of temporary curing irradiators 13 and a real curing irradiator 14. The plurality of temporary curing irradiators 13 is provided to line up along the circumferential surface of the rotating drum 8 alternately, one for each of the plurality of head units 11. The temporary curing irradiators 13 are provided on the downstream side of the feed path of the printing medium 100 in relation to the corresponding head units 11. The temporary curing irradiators 13 irradiate the printing medium 100 onto which the UV ink is ejected with ultraviolet rays. Accordingly, the UV ink is temporarily cured straight after landing on the printing medium 100, and spreading of the dots and mixing of the colors are suppressed. The real curing irradiator 14 is provided closer to the downstream side than the temporary curing irradiator 13 which is provided closest to the downstream side in the feed path. The real curing irradiator 14 irradiates the printing medium 100 which is subjected to the ejection of the UV inks and the temporary curing with ultraviolet rays of a greater integral light quantity than the temporary curing irradiators 13. Accordingly, the UV ink which lands on the printing medium 100 is completely cured and is fixed to the printing medium 100.

Note that, it is possible to use, for example, a light emitting diode (LED) lamp, a high pressure mercury lamp, or the like which radiates ultraviolet rays in the temporary curing irradiators 13 and the real curing irradiator 14.

Figure 2:
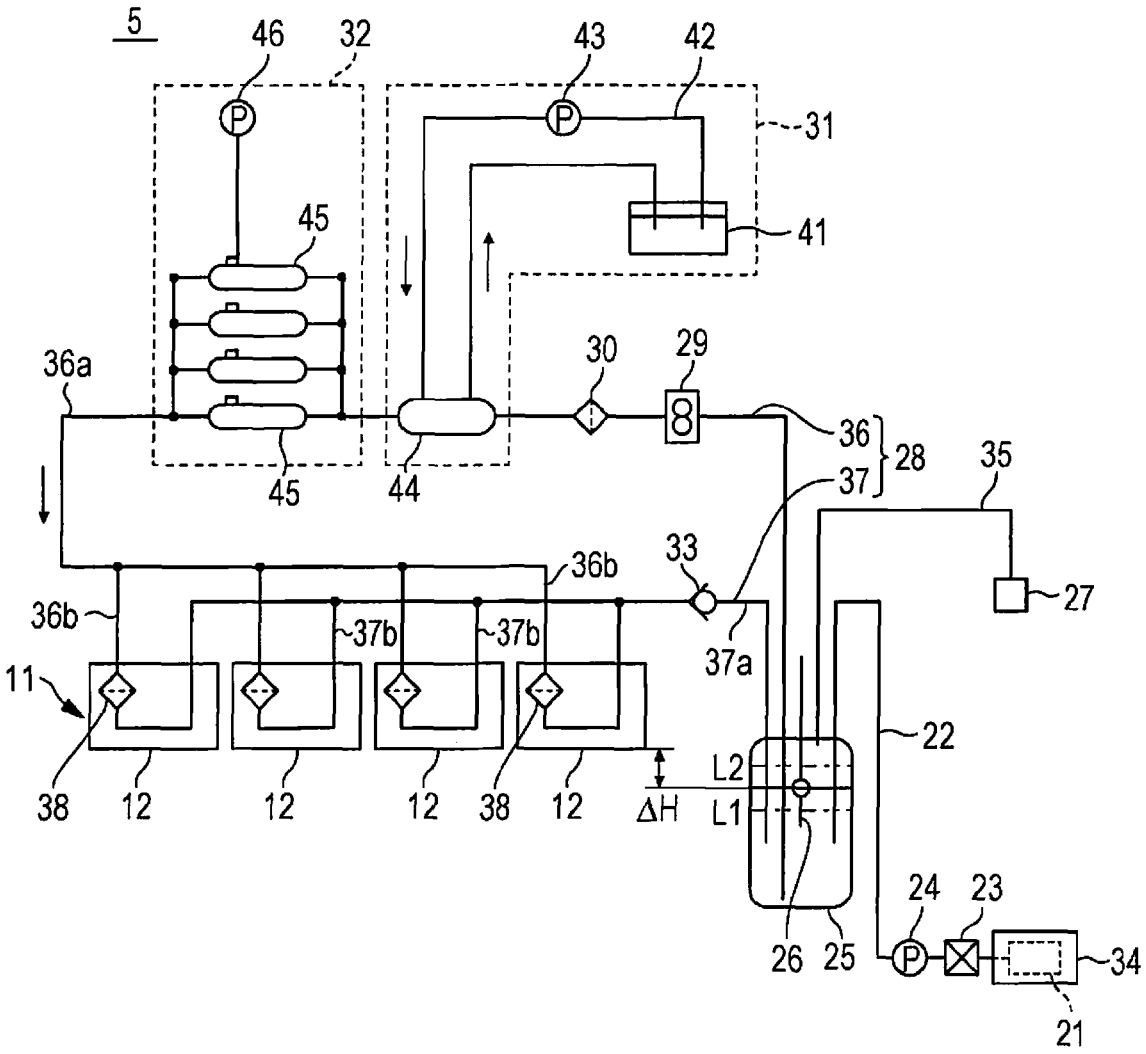
FIG. 2 is a piping flow diagram illustrating an ink supply section which is provided in the printing apparatus illustrated in FIG. 1.

Description will be given of the ink supply section 5 with reference to FIG. 2. The ink supply section 5 is provided with an ink cartridge 21, a supply flow path 22, an open-close valve 23, a supply pump 24, a sub-tank 25, a liquid level sensor 26, a compressing-decompressing section 27, an ink circulation flow path 28, an outgoing path filter 30, a heating section 31, a degassing section 32, and a check valve 33.

The UV ink is stored in the ink cartridge 21. The ink cartridge 21 is mounted in a holder 34. The upstream end of the supply flow path 22 is inserted into the ink cartridge 21 which is mounted in the holder 34, and the downstream end of the supply flow path 22 is inserted into the sub-tank 25. In order from the upstream side, the open-close valve 23 and the supply pump 24 are provided in the supply flow path 22. The open-close valve 23 opens and closes the supply flow path 22. It is possible to use a magnetic operation valve, for example, as the open-close valve 23. The supply pump 24 supplies the UV ink which is stored in the ink cartridge 21 to the sub-tank 25 via the supply flow path 22.

The sub-tank 25 temporarily reserves the UV ink which is pumped from the ink cartridge 21. The sub-tank 25 is an open system tank. The liquid level sensor 26 detects whether or not the liquid level of the UV ink in the sub-tank 25 is greater than or equal to a first liquid level L1, and detects whether or not greater than or equal to a second liquid level L2 which is greater than the first liquid level L1. When the liquid level sensor 26 detects that the liquid level of the UV ink in the sub-tank 25 is less than the first liquid level L1, the UV ink is supplied from the ink cartridge 21 to the sub-tank 25. When the liquid level sensor 26 detects that the liquid level of the UV ink in the sub-tank 25 is greater than or equal to the second liquid level L2, the supply of the UV ink from the ink cartridge 21 to the sub-tank 25 is stopped. Accordingly, the liquid level of the sub-tank 25 is maintained between the first liquid level L1 and the second liquid level L2. Therefore, a differential head $\Delta H$ between the nozzle surface of the ink ejecting head 12 and the liquid surface of the sub-tank 25 is maintained within a predetermined range. Accordingly, the back pressure (hereinafter referred to as "head back pressure") of the UV ink inside the ink ejecting head 12 is maintained within a predetermined range (for example, −400 Pa to 3000 Pa), and a good meniscus is formed in the nozzles of the ink ejecting head 12.

The compressing-decompressing section 27 compresses or decompresses the inside of the sub-tank 25 by supplying air into the sub-tank 25 or discharging the air in the sub-tank 25 via an air flow path 35. For example, the compressing-decompressing section 27 compresses the sub-tank 25 during the initial filling of the first circulation flow path 28 with the UV ink, during the cleaning of the ink ejecting heads 12, or the like.

The ink circulation flow path 28 is the flow path of the UV ink which passes from the sub-tank 25, through the ink ejecting heads 12, and returns to the sub-tank 25. The ink circulation flow path 28 is provided with a circulation outgoing path 36 and a circulation return path 37.

The UV ink which is supplied to the ink ejecting heads 12 from the sub-tank 25 flows in the circulation outgoing path 36. The circulation outgoing path 36 is provided with an outgoing path side root path 36*a* and a plurality of outgoing path side branch paths 36*b* which branch from the outgoing path side root path 36*a*. The upstream end of the outgoing path side root path 36*a* is inserted into the sub-tank 25. In order from the upstream side, the outgoing path side root path 36*a* is provided with a circulation pump 29, the outgoing path filter 30, the heating section 31, and the degassing section 32. One of the outgoing path side branch paths 36*b* is provided for one of the ink ejecting heads 12. The downstream end of the outgoing path side branch path 36*b* is connected to the ink ejecting head 12.

The UV ink which returns to the sub-tank 25 from the ink ejecting head 12 flows in the circulation return path 37. In other words, of the UV ink which is supplied from the sub-tank 25 to the ink ejecting head 12 via the circulation outgoing path 36, the UV ink which is not ejected from the ink ejecting heads 12 returns to the sub-tank 25 via the circulation return path 37. The circulation return path 37 is provided with a plurality of return path side branch paths 37*b*, and a return path side root path 37*a* at which the plurality of return path side branch paths 37*b* meet n the downstream side thereof. One of the return path side branch paths 37*b* is provided for one of the ink ejecting heads 12. The upstream end of the return path side branch path 37*b* is connected to the ink ejecting head 12. The downstream end of the return path side root path 37*a* is inserted into the sub-tank 25. The check valve 33 is provided in the return path side root path 37*a*.

The circulation pump 29 pumps the UV ink which is reserved in the sub-tank 25 toward the ink ejecting head 12 side. Therefore, when the circulation pump 29 operates, the UV ink circulates within the ink circulation flow path 28. It is possible to favorably use a gear pump as the circulation pump 29 because it is possible to suppress pulsation and there is little fluctuation in the flow rate with the passage of time.

The outgoing path filter 30 removes foreign matter in the UV ink by filtering the UV ink which flows in the circulation outgoing path 36. Examples of the foreign matter include a polymer of the UV ink caused by friction heat which is generated by the circulation pump 29 which is a gear pump, dust and bubbles which are mixed in when the upstream end of the supply flow path 22 is inserted into the ink cartridge 21, and the like. Note that, although head filters 38 which filter the UV ink are also provided on the inlet side of the ink ejecting heads 12, it is possible to cause the head filters 38 which are difficult to exchange to last a long time by providing the outgoing path filter 30 in the circulation outgoing path 36.

The heating section 31 heats the UV ink which flows in the ink circulation flow path 28 to a predetermined temperature (for example 35° C. to 40° C.) The predetermined temperature is a temperature at which the UV ink which is supplied to the ink ejecting heads 12 reaches a viscosity which is appropriate for ejection from the ink ejecting heads 12. During the start-up of the printing apparatus 1, the printing apparatus 1 starts the printing operation after heating the UV ink which has a lower temperature than the predetermined temperature to the predetermined temperature using the heating section 31.

The heating section 31 is provided with a hot water tank 41 including a heater, a hot water circulation flow path 42, a hot water pump 43, and a heat exchanger 44. The hot water tank 41 reserves hot water which is adjusted to fall within a predetermined temperature range. The hot water circulation flow path 42 is a flow path running from the hot water tank 41, through the heat exchanger 44, and returns to the hot water tank 41. The hot water pump 43 causes the hot water to circulate within the hot water circulation flow path 42. The heat exchanger 44 performs heat exchanging between the hot water which flows in the hot water circulation flow path 42 and the UV ink which flows in the ink circulation flow path 28.

The degassing section 32 degasses the UV ink which flows in the ink circulation flow path 28. Accordingly, the supplying of the UV ink containing bubbles to the ink ejecting heads 12 is prevented. The degassing section 32 is provided with a degassing module 45 and a negative pressure pump 46. The degassing module 45 is provided with a plurality of hollow fiber membranes, for example. The negative pressure pump 46 reduces the pressure outside of the hollow fiber membranes. Accordingly, the UV ink which flows in the hollow fiber membranes is degassed.

Incidentally, in the circulation return path 37, there is a case in which the UV ink flows backward to the ink ejecting head 12 side. For example, a case in which the circulation return path 37 is removed from the sub-tank 25 in order to exchange a portion of the ink ejecting heads 12, or a case in which, during the cleaning of the ink ejecting head 12 which is performed by causing the UV ink to circulate within the ink circulation flow path 28 using the circulation pump 29 while compressing the sub-tank 25 using the compressing-decompressing section 27, the circulation pump 29 stops due to a malfunction or the like. In these cases, as described above, when foreign matter is contained in the UV ink which flows in the circulation return path 37, there is a concern that foreign matter contained in the UV ink will flow into the ink ejecting heads 12 together with the backward flow of the UV ink to the ink ejecting head 12 side in the circulation return path 37.

In order to prevent the flowing of foreign matter into the ink ejecting heads 12 together with the backward flow of the UV ink to the ink ejecting head 12 side in the circulation return path 37, in the printing apparatus 1 of the present embodiment, the check valve 33 is provided in the return path side root path 37*a* of the circulation return path 37. The check valve 33 allows the flowing of the UV ink from the ink ejecting head 12 side to the sub-tank 25 side in the circulation return path 37 (a forward direction), and prevents the backward flowing of the UV ink from the sub-tank 25 side to the ink ejecting head 12 side (a reverse direction). In other words, the circulation return path 37 is opened by the check valve 33 when the UV ink flows in the forward direction in the circulation return path 37, and the circulation return path 37 is closed by the check valve 33 when the UV ink flows in the reverse direction in the circulation return path 37. Therefore, the flowing of foreign matter contained in the UV ink which flows backward into the ink ejecting heads 12 is suppressed. Therefore, according to the printing apparatus 1 of the present embodiment, it is possible to suppress the flowing of foreign matter into the ink ejecting heads 12 together with the backward flow of the UV ink to the ink ejecting head 12 side in the circulation return path 37. It is possible to use, as appropriate, a well known system such as a sliding system, a lift system, or a disc system for the check valve 33.

In the check valve 33, the pressure loss is extremely small (for example, approximately 200 Pa), and the influence of the pressure loss by the check valve 33 on the head back pressure is small. Therefore, in order to retain the head back pressure within a predetermined range, it is not necessary to increase a differential head ΔH of the negative pressure on the ink ejecting heads 12. Therefore, it is possible to reduce restrictions to the layout of the sub-tank 25. In addition, even when the circulation of the UV ink in the ink circulation flow path 28 is stopped, a great reduction in the head back pressure is suppressed. Therefore, according to the printing apparatus 1 of the present embodiment, even when the circulation of the UV ink in the ink circulation flow path 28 is stopped, the entry of bubbles from the nozzles of the ink ejecting heads 12 is suppressed. The check valve 33 is beneficial since the replacement thereof is substantially unnecessary.

Since the check valve 33 is provided in the return path side root path 37*a*, even if the check valve 33 is not provided in each of the return path side branch paths 37*b*, it is possible to suppress the flowing of foreign matter into the plurality of ink ejecting heads 12 together with the backward flow of the UV ink to side of the plurality of ink ejecting heads 12 in the circulation return path 37. Therefore, according to the printing apparatus 1 of the present embodiment, it is possible to reduce the number of the check valves 33 in comparison to a case in which the check valve 33 is provided for each of the return path side branch paths 37*b*.

Note that, the sub-tank 25 is an example of "an ink reservoir section". The check valve 33 is an example of "an open-close section".

In order to prevent the flowing of foreign matter into the ink ejecting heads 12 together with the backward flow of the UV ink to the ink ejecting head 12 side in the circulation return path 37, it is conceivable to also provide a filter in the circulation return path 37 in the same manner as the outgoing path filter 30 is provided in the circulation outgoing path 36 instead of providing the check valve 33 in the circulation return path 37. However, since it is necessary to exchange the filter for a new filter when the filter is used to a certain extent, costs are increased. While the head back pressure is applied based on the differential head ΔH and the pressure loss of the UV ink in the circulation return path 37, when a filter is provided in the circulation return path 37, the pressure loss of the UV ink in the circulation return path 37 increases by approximately 10 kPa, for example. Therefore, in order to retain the head back pressure within a predetermined range, the differential head ΔH of the negative pressure on the ink ejecting heads 12 should be increased in response to the increase in the pressure loss. In other words, the sub-tank 25 should be provided further below the ink ejecting heads 12. Therefore, the layout of the sub-tank 25 is restricted. In addition, in this case, when the circulation of the UV ink in the ink circulation flow path 28 is stopped during the stopping of the operation of the printing apparatus 1 or the like, since, of the differential head ΔH and the pressure loss, only the differential head ΔH of the increased negative pressure affects the head back pressure, the head back pressure is greatly reduced. Therefore, there is a concern that bubbles will enter from the nozzles of the ink ejecting heads 12. Therefore, in order to prevent the flowing of foreign matter into the ink ejecting heads 12 together with the backward flow of the UV ink to the ink ejecting head 12 side in the circulation return path 37, it is more preferable to provide the check valve 33 in the circulation return path 37 than the filter.

The invention is not limited to the embodiment described above, and it goes without saying that various configurations may be adopted within a scope that does not depart from the gist of the invention. For example, the present embodiment may be modified to the forms described below.

Figure 3:
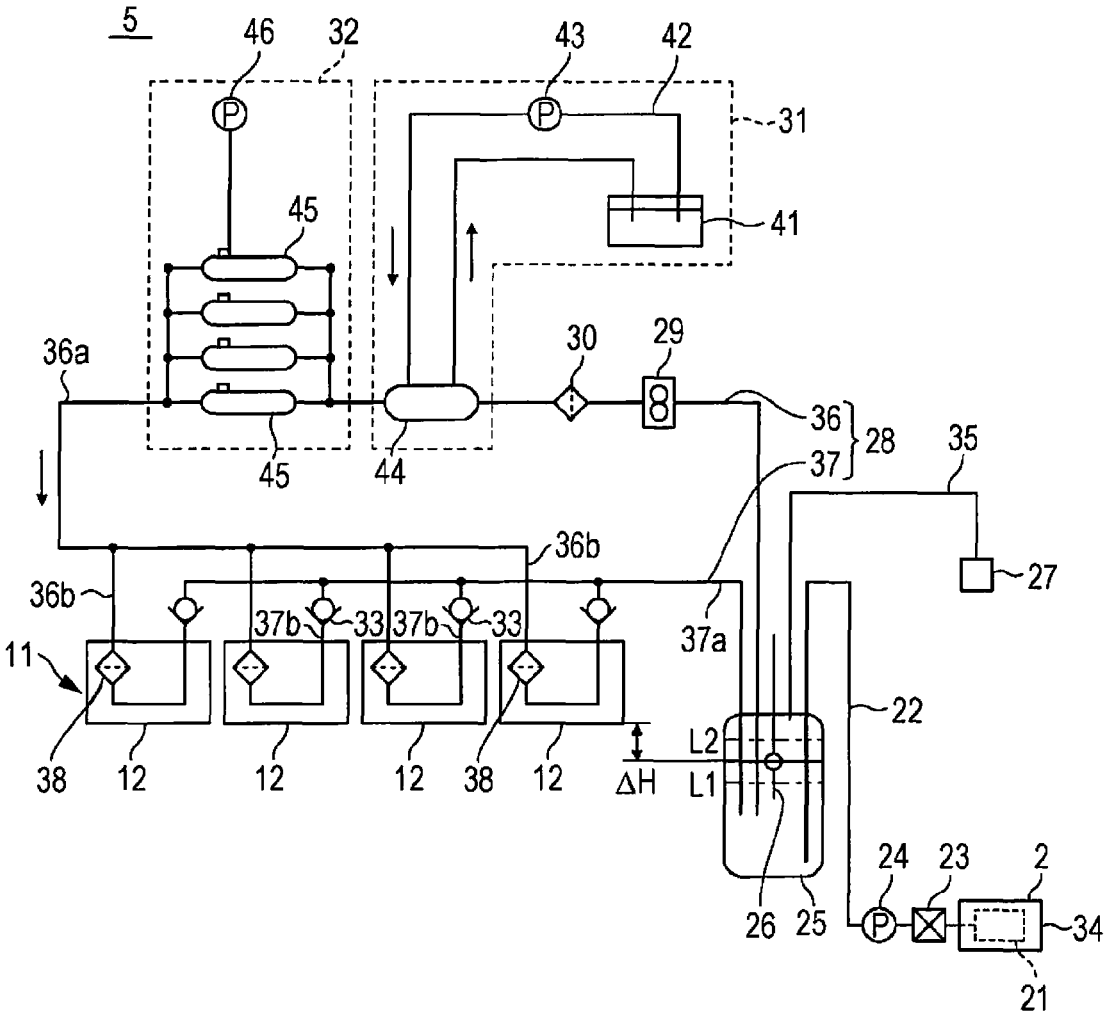
FIG. 3 is a piping flow diagram illustrating an ink supply section according to a modification example.

As illustrated in FIG. 3, the check valves 33 may be provided in each of the return path side branch paths 37*b* instead of providing the check valve 33 in the return path side root path 37*a*. In this case, in comparison with the case in which the check valve 33 is provided in the return path side root path 37*a*, it is possible to more reliably suppress the entry of foreign matter to the ink ejecting heads 12 together with the backward flow of the UV ink to the ink ejecting head 12 side in the circulation return path 37. Naturally, the check valves 33 may be provided in each of the return path side root path 37*a* and the return path side branch paths 37*b*.

The open-close section which is provided in the circulation return path 37 is not limited to the check valve 33. For example, it is possible to use a magnetic operation valve which opens the circulation return path 37 when the UV ink flows to the sub-tank 25 in the circulation return path 37 and closes the circulation return path 37 when the UV ink flows to the ink ejecting heads 12 in the circulation return path 37, or a manual operation valve. Note that, when using the check valve 33 as the open-close section, it is not necessary to open and close the circulation return path 37 by electrical control or by the operation of an operator, and it is possible to increase the reliability as an open-close section.

The ink which is used in the printing apparatus 1 is not limited to the UV ink, and, for example, may be an aqueous ink, an oil-based ink, a solvent ink, or a volatile ink.

The entire disclosure of Japanese Patent Application No. 2015-055790, filed Mar. 19, 2015 is expressly incorporated by reference herein.

What is claimed is:

1. A printing apparatus comprising:

an ink ejecting head which ejects an ink;

an ink reservoir section which reserves the ink;

an ink circulation flow path which includes a circulation outgoing path in which the ink which is supplied to the ink ejecting head from the ink reservoir section flows when the ink is ejected from the ink ejecting head and a circulation return path in which a part of the ink which is not ejected from the ink ejecting head among the ink supplied via the circulation outgoing path flows when the part of the ink returns to the ink reservoir section; and a check valve which is provided in the circulation return path, the check valve being configured to allow the ink to flow in the circulation return path in a forward direction in which the ink flows from the ink ejecting head to the ink reservoir section, and prevent the ink from flowing in the circulation return path in a reverse direction in which the ink flows from the ink reservoir section to the ink ejecting head, a first end of the circulation return path being connected to the ink ejecting head and a second end of the circulation return path being connected to the ink reservoir section, and the check valve being further configured to prevent the ink from flowing from the ink reservoir section to the ink ejecting head when the second end of the circulation return path is removed from the ink reservoir section.

2. The printing apparatus according to claim 1, further comprising:

an additional ink ejecting head which ejects an ink, wherein the circulation return path contains a plurality of branch paths, one end portion of each branch path being joined to the corresponding ink ejecting head, and a root path at which the plurality of branch paths merge at another end portion side of the branch paths, and the open-close section is provided in the root path.

3. The printing apparatus according to claim 1, further comprising:

a filter which is provided in the circulation outgoing path and filters the ink.

4. The printing apparatus according to claim 1, wherein a back pressure within a predetermined range is applied to the ink inside the ink ejecting head based on a differential head between the ink ejecting head and the ink reservoir section and a pressure loss of the ink in the circulation return path.

5. The printing apparatus according to claim 1, further comprising:

a circulation pump which is provided in the ink circulation flow path and causes the ink to circulate within the ink circulation flow path.

6. The printing apparatus according to claim 1, further comprising:

a filter which is provided in the circulation outgoing path and filters the ink, wherein no filter is provided in the circulation return path.

7. The printing apparatus according to claim 1, wherein a differential head between a nozzle surface of the ink ejecting head and a liquid surface of the ink in the ink reservoir section is maintained such that a back pressure of the ink inside the ink ejecting head is maintained within a predetermined range.

8. The printing apparatus according to claim 7, wherein the predetermined range is from −400 Pa to 3000 Pa.

9. A printing apparatus comprising:

a plurality of ink ejecting heads which eject an ink;

an ink reservoir section which reserves the ink;

an ink circulation flow path which includes a circulation outgoing path in which the ink which is supplied to the ink ejecting heads from the ink reservoir section flows when the ink is ejected from the ink ejecting heads and a circulation return path in which a part of the ink which is not ejected from the ink ejecting heads among the ink supplied via the circulation outgoing path flows when the part of the ink returns to the ink reservoir section; and a plurality of check valves which are provided in the circulation return path, the circulation return path containing a plurality of branch paths at first end of the circulation return path, one end portion of each branch path being connected to the corresponding ink ejecting head, and a second end of the circulation return path being connected to the ink reservoir section, each of the check valves being provided in each of the branch paths, each of the check valves being configured to allow the ink to flow in the circulation return path in a forward direction in which the ink flows from the ink ejecting heads to the ink reservoir section, and prevent the ink from flowing in the circulation return path in a reverse direction in which the ink flows from the ink reservoir section to the ink ejecting heads, and each of the check valves being further configured to prevent the ink from flowing from the ink reservoir section to the ink ejecting heads when the second end of the circulation return path is removed from the ink reservoir section.

* * * * *